US007669385B2

(12) United States Patent
Sichera et al.

(10) Patent No.: US 7,669,385 B2
(45) Date of Patent: Mar. 2, 2010

(54) MACHINE FOR PACKAGING ARTICLES, IN PARTICULAR CDS, DVDS AND THE LIKE, INTO CONTAINERS

(75) Inventors: Massimiliano Sichera, Renazzo di Cento (IT); Gianni Sichera, Pieve di Cento (IT)

(73) Assignee: Sichera S.r.l., Castellod'Argile (Bolongna) (IT)

( * ) Notice: Subject to any disclaimer, the term of this patent is extended or adjusted under 35 U.S.C. 154(b) by 910 days.

(21) Appl. No.: 10/416,661

(22) PCT Filed: Nov. 13, 2001

(86) PCT No.: PCT/IB01/02131

§ 371 (c)(1),
(2), (4) Date: May 14, 2003

(87) PCT Pub. No.: WO02/40349

PCT Pub. Date: May 23, 2002

(65) Prior Publication Data

US 2004/0025471 A1 Feb. 12, 2004

(30) Foreign Application Priority Data

Nov. 14, 2000 (IT) ..... BO2000A0654

(51) Int. Cl.
*B65B 57/00* (2006.01)
*B65B 43/38* (2006.01)

(52) U.S. Cl. ..... 53/53; 53/55; 53/157; 53/564; 53/238; 53/250; 53/254; 53/382.1

(58) Field of Classification Search ..... 53/238, 53/568, 254, 468, 476, 484, 474, 443, 382.1, 53/382.2, 381.1; 414/754, 729, 788.1, 795.4; 198/470.1, 469.1, 475.1, 468.3
See application file for complete search history.

(56) References Cited

U.S. PATENT DOCUMENTS 5,341,624 A * 8/1994 Kaye ..... 53/238

(Continued)

FOREIGN PATENT DOCUMENTS

WO WO 00 44622 8/2000

*Primary Examiner*—Stephen F. Gerrity
(74) *Attorney, Agent, or Firm*—William J. Sapone; Coleman Sudol Sapone, P.C.

(57) ABSTRACT

A machine for packaging articles, in particular CDs, DVDs and the like, into relative containers, which are formed by a pair of substantially box-like closure members, lower (GD and upper (G2), hinged to each other along a common hinge edge (D), includes a conveying line (L), which is equipped all around with gripping and transferring devices (1). The gripping and transferring devices (1) are moved continuously and grip lateral edges of die iowa closure member (G1) of the containers (C) housed in closed condition inside a magazie (S0) and remove the containers (C) from the bottom of the magazine (S0). The gripping and transferring devices (1) transfer the containers withdrawn from the magazine (S0) to subseqaent working stations associated to the line (L). The working stations, in suitable and mutual time relation with the forward movement of the gripping and transferring devices (1), open the containers by opening the upper closure member (G2) with respect to the lower closure member (G1), insert at least one informative leaflet (Li) and at least one of said articles (10) into the closure members, insert a cover sheet F between the closure members (G1, G2) and a protective film applied onto the closure members, and finally, close the container

27 Claims, 11 Drawing Sheets

U.S. PATENT DOCUMENTS 5,454,215 A * 10/1995 Martelli ..... 53/564
5,509,257 A * 4/1996 Tagliaferri et al. ..... 53/566
5,664,405 A * 9/1997 Perego ..... 53/564
5,788,114 A * 8/1998 Perego ..... 53/468
5,943,845 A * 8/1999 Ilsemann ..... 53/254
6,006,494 A * 12/1999 Zaniboni ..... 53/387.2
6,032,435 A * 3/2000 Zaniboni ..... 53/157
6,035,605 A * 3/2000 Perego ..... 53/157
6,238,172 B1 * 5/2001 Onishi ..... 53/254
6,367,231 B1 * 4/2002 Yamamoto ..... 53/469
6,374,574 B1 * 4/2002 Onishi ..... 53/238
6,397,564 B1 * 6/2002 Yamamoto ..... 53/244
6,418,703 B1 * 7/2002 Yamamoto ..... 53/564
6,527,500 B1 * 3/2003 Gelardi et al. ..... 53/238
6,536,194 B2 * 3/2003 Minardi ..... 53/564
6,786,024 B2 * 9/2004 Sichera et al. ..... 53/238

* cited by examiner

FIG.3
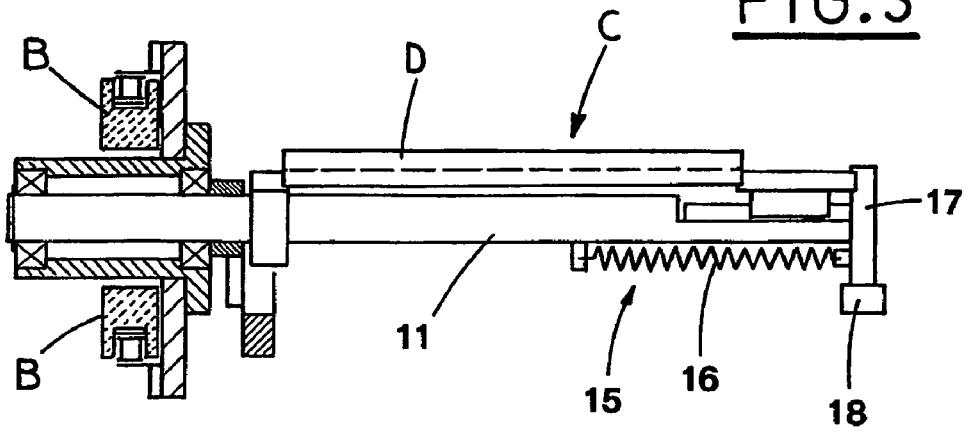
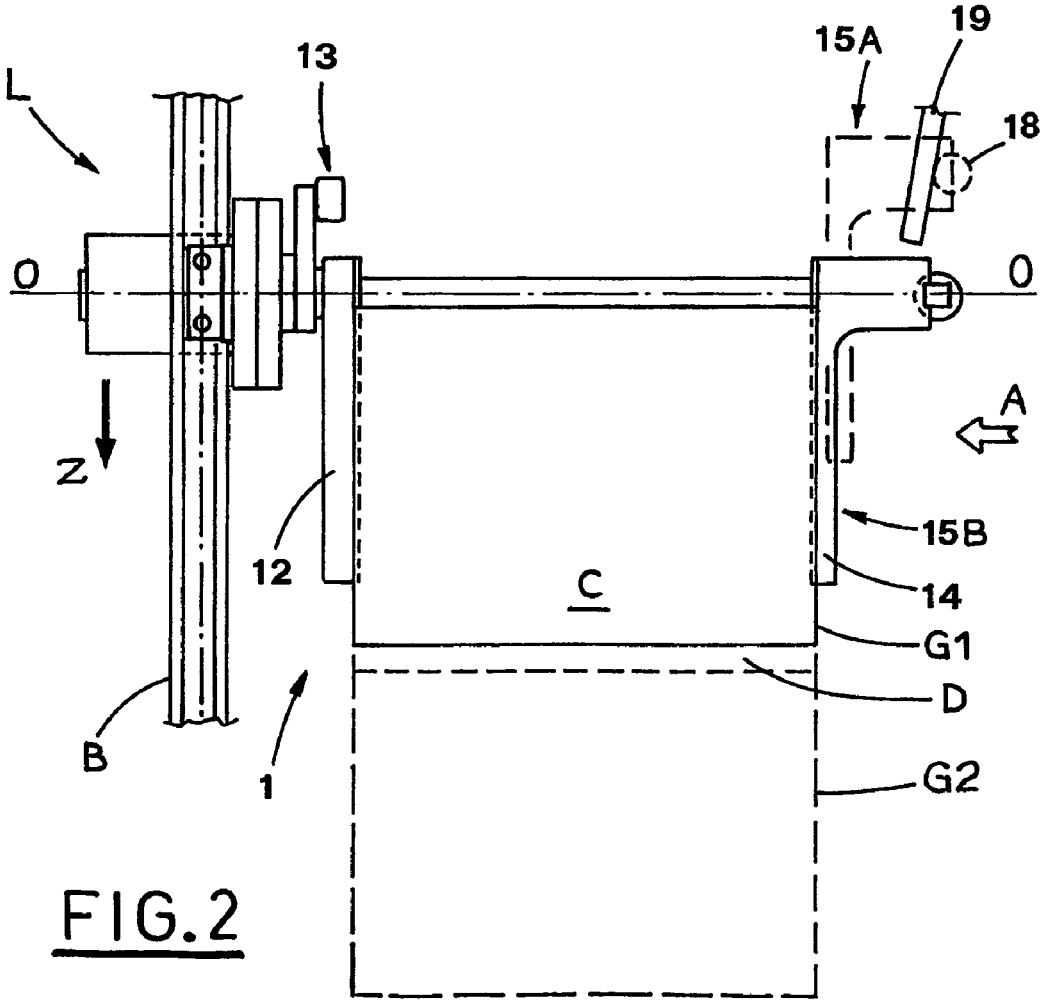
FIG.2

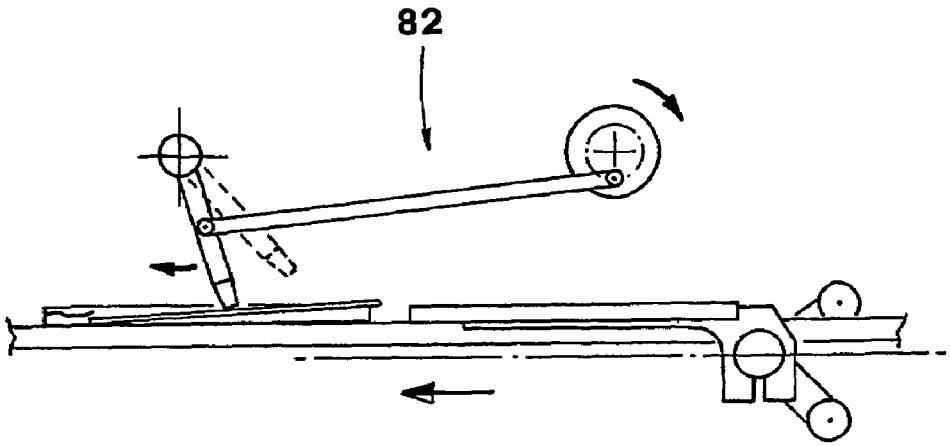
FIG. 7b
FIG. 7c
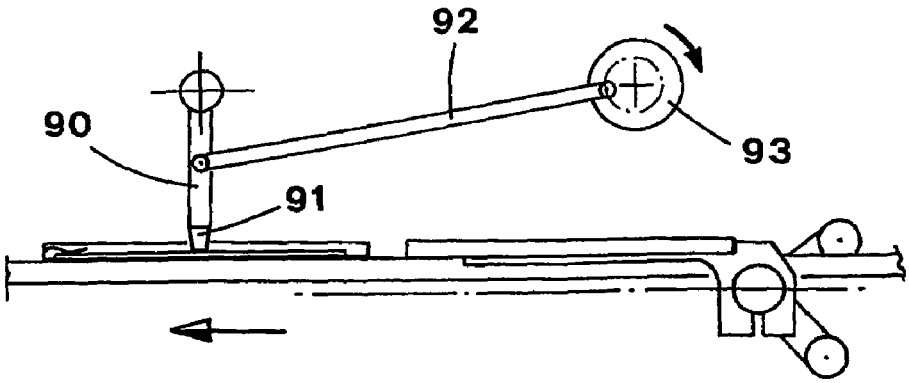

FIG.9
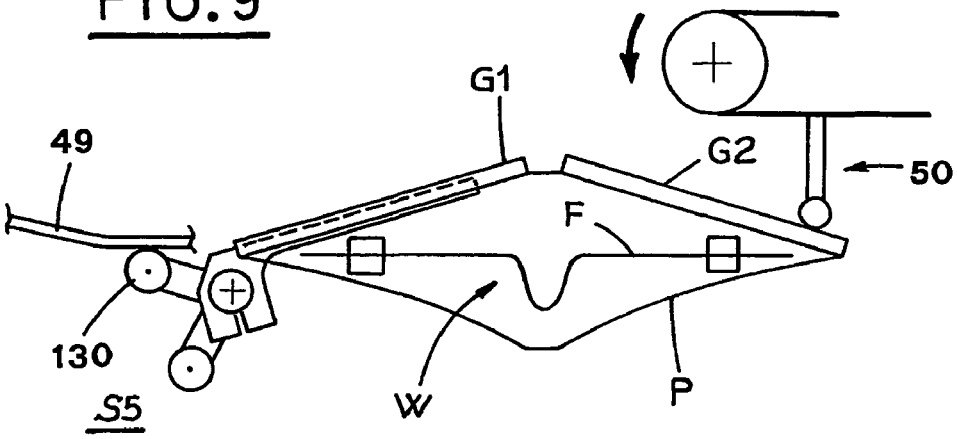
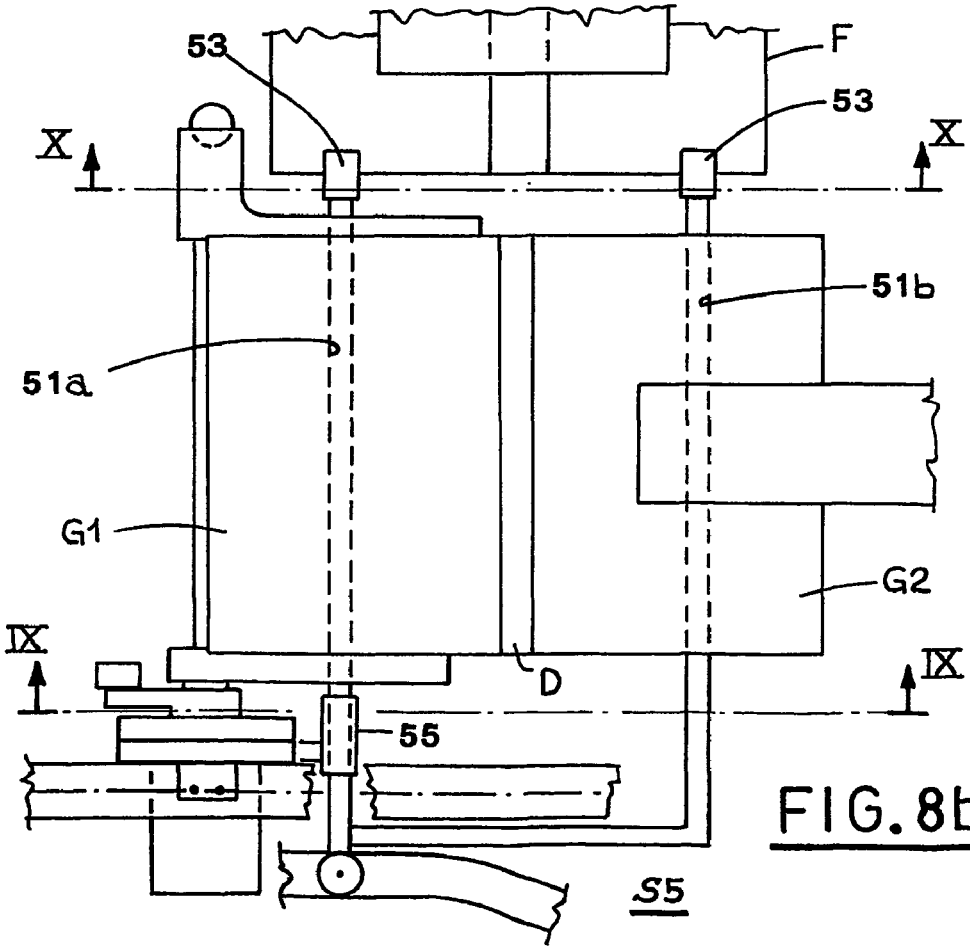
FIG.8b

MACHINE FOR PACKAGING ARTICLES, IN PARTICULAR CDS, DVDS AND THE LIKE, INTO CONTAINERS

TECHNICAL FIELD OF THE INVENTION

The present invention relates to the technical field concerning machines for packaging articles, e.g. opto-magnetic supports, like compact discs, CD ROMs, DVDs, etc. into respective holders.

DESCRIPTION OF PRIOR ART

There are known machines for packaging articles, e.g. compact discs, of DVD type (ROM Digital Versatile Disk) into related containers made of plastic material.

The containers are formed by a pair of planar substantially box-like closure members, which are hinged to each other along a hinge edge and have suitable snap locking means, situated on edges opposite to the hinge edge.

Each one of the two closure members is equipped with suitable means, situated near the inner surface, for receiving and holding, respectively the article and a booklet or leaflet with information about the article.

Sometimes, the closure members are wrapped externally with a transparent protective film, fastened to the closure members along the edges opposite to the common hinge edge.

Thus, a kind of pocket is formed between the protective film and the outer surfaces of the two closure members, where a cover sheet is introduced.

Known machines currently used for packaging articles into the above mentioned containers include basically a conveyor, operated stepwise, which extends along a straight path and passes through subsequent and consecutive working stations.

In particular, the working stations situated from upstream to downstream of the conveyor are as follows:

- a magazine for containers set in closed condition;
- a device for transferring closed containers up to relative seats made in the conveyor;
- a working unit for opening the container by opening the closure members by an angle substantially of 180° to define a flat configuration;
- a transferring unit for picking up inserts from a relative magazine and for introducing them into the corresponding closure member:
- one or more units for picking up articles from a relative magazine and for transferring and inserting them into a corresponding closure member of the container;
- a device for closing the container.

In some cases, there is another working station, situated upstream of the container closing device and aimed at inserting a cover sheet between the protective film and the container closure members.

Thus, the above mentioned stations must necessarily work in suitable time relation with the stepwise movement of the conveyor: in particular, each working step must be performed during each dwell step of the conveyor.

Thus, it is evident that each single station does not work at its full capacity, since each operation must be followed by a pause for waiting the conveyor stop at the subsequent step.

The need to obtain a continuous and constant increase of the production rate has resulted in changes of the design of the mechanical means of single stations in order to optimize its performance.

However, until now, the attempts have not produced the expected results and have caused considerable increase of design and production costs.

SUMMARY OF THE INVENTION

The main object of the present invention is to propose a machine for automatically and continuously packaging articles, in particular CDs, DVDs and the like, into relative holders.

Another important object of the present invention is to propose a machine for packaging articles, in particular CDs, DVDs and the like into related containers, which ensures a constant, high and continuous working speed thus increasing the production rate with respect to known machines and maintaining the costs substantially low.

A further object of the present invention is to propose a machine, which can optimize and coordinate all the working steps necessary for packaging articles into relative containers obtained by a simple, extremely functional and reliable technical solution.

The above mentioned objects are obtained according to the invention, by the present machine for packaging articles, in particular CDs, DVDs and the like, into relative containers, the latter being formed by a pair of substantially box-like closure members, lower G1 and upper G2, hinged to each other along a common hinge edge D, and equipped with locking means situated on the edges opposite to said edge D, said closure members being aimed at receiving respectively, in suitable means situated in the respective inner surfaces, at least one relative article 10 and at least one informative booklet Li, said machine being characterized in that it includes a conveying line L, which is peripherally equipped with gripping and transferring means 1 aimed at gripping lateral edges of said lower closure member G1 of said containers C housed in closed condition inside a magazine S0 and at removing said containers C from the bottom of said magazine S0 and transferring them to subsequent working stations connected to the line L, said working stations being designed to open, in suitable and mutual time relation with the forward movement of said gripping and transferring means 1, the containers by opening the upper closure member G2 with respect to the lower closure member G1, to insert into said closure members, respectively, at least one informative leaflet Li and at least one of said articles 10, and finally, to close the container.

BRIEF DESCRIPTION OF FIGURES

The characteristic features of the invention are pointed out in the following description of the preferred embodiments of the machine for packaging articles, in particular CDs, DVDs and the like, into related containers, shown as example in the enclosed drawings, in which:

FIG. 2 is a schematic plan view of the working means for picking up and transferring the containers of the proposed machine;

FIG. 3 is a front view of the means of FIG. 2;

FIG. 7 shows the introduction of the informative leaflet into a corresponding closure member of a container, while FIGS. 7*a*, 7*b* and 7*c* show a particular, but not the only embodiment of an introducing device D3;

FIG. 8*a* is a schematic, partial, plan view, of a particular working station of the proposed machine, aimed at introducing the cover sheet between the protective film and the container closure members, while FIG. 8*b* is a schematic view of the working means of this station;

FIG. 9 is a section view taken along IX—IX of FIG. 8*b;*

DESCRIPTION OF THE PREFERRED EMBODIMENTS

Figure 1:
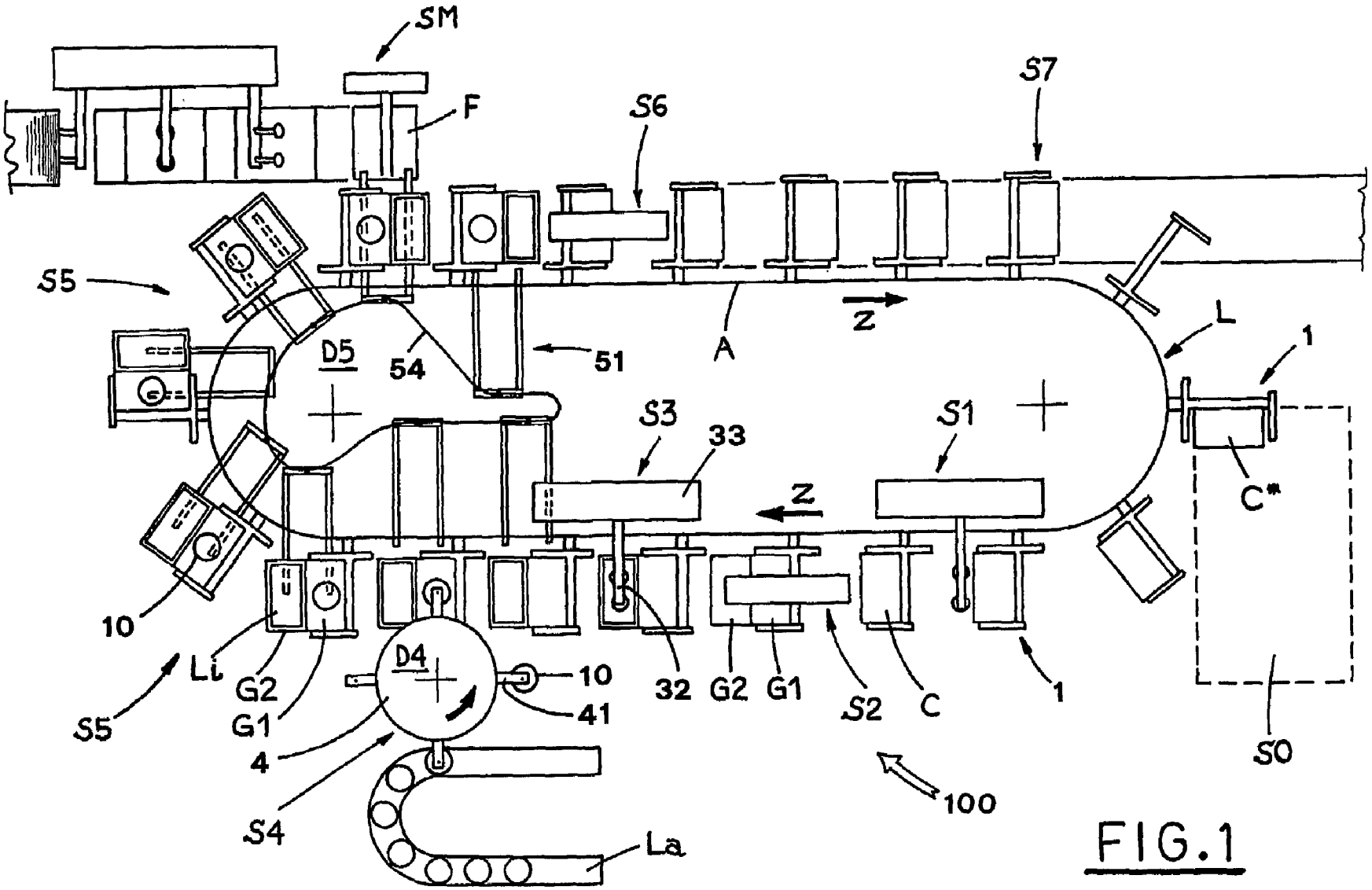
FIG. 1 is a schematic plan view of the machine for packaging articles, in particular CD, DVD and the like, into related containers, proposed by the present invention.

With reference to the above described figures, the reference numeral 100 indicates a machine for packaging articles 10, in particular CDs, DVDs and the like, into related containers C.

The containers C are formed by a pair of substantially box-like planar closure members, namely a lower member G1 and an upper member G2, which are joined to each other along a common hinge edge D and equipped with suitable snap locking means, situated on edges opposite to the hinge edge D.

The closure members G1, G2 receive, in suitable means made in their inner surfaces, at least one article 10 and an informative leaflet Li, respectively.

In some cases, the above mentioned containers C can be added of a transparent protective film P wrapping externally the closure members G1, G2 and fastened thereto along edges opposite to the hinge edge D.

The film P defines a kind of pocket, between the film and the closure members, into which a cover sheet F is introduced.

The proposed machine 100 for packaging articles 10 includes basically a conveying line L, situated, as shown for example in FIG. 1, on a substantially horizontal plane, and extending along a close-loop path A.

The conveying line L includes, situated in its peripheral area, gripping and transferring means 1 (see for instance FIGS. 2 and 3), which are moved in a continuous fashion along the above mentioned close-loop path A.

The gripping and transferring means 1 grip the lateral edges of the lower closure member G1 of a corresponding lowermost container C* of the pile of containers C, arranged one over another in closed condition inside a magazine S0, which is situated beside the line L, and remove the lowermost container C* from the bottom of the magazine S0 to transfer it to subsequent working stations situated beside the line L along the close-loop path A.

The subsequent working stations work in suitable time relation with the continuous forward movement of the gripping and transferring means 1, so as to package the articles 10 into the containers C.

In the subsequent working stations the containers are unclosed, then the closure members G2, G1 are opened e.g. substantially up to 180°, afterwards an informative leaflet Li and at least one article 10 are inserted into respective closure members G2, G1, and finally, the containers are closed.

If the containers C have the protective film P, there are other working stations for introducing a cover sheet F between the protective film P and the closure members G1, G2 of the container C.

It is to be pointed out that the conveying line L can extend also along a path on a substantially vertical plane (not shown), including for example an upper working forward section and a lower non-working return section.

The above mentioned gripping and transferring means 1 include a main arm 11, which is transversely supported by a guiding track B of the conveying line L and which is driven, by a rocking system 13, so as to rotate on an axis O lying on a plane of the line L and perpendicular to the forward movement direction Z thereof.

The main arm 11 is equipped with a pair of grippers, first motionless 12 and second axially moving 14, which are parallel to each other.

The grippers are cantilevered to the above main arm 11 according to the forward movement direction of the line L, and can be opened, by a transmission system 15, to pass from a parted away condition 15A to a close condition 15B.

The pair of grippers, motionless 12 and moving 14, opened and brought to the parted away condition 15A by the transmission system 15, are first moved by the line L in correspondence to the magazine S0 until they engage the lower closure member G1 in a relative container C* contained in the magazine S0.

Later on, the grippers are operated by the transmission system 15 to take the close position 15B, in which they grip the lateral edges of the lower closure member G1 to remove the container from the magazine S0 and to transfer it toward the subsequent working stations.

The transmission system 15 (as for instance shown in detail in FIGS. 2 and 3), includes a traction spring 16, whose first extremity is fastened to the lower area of the transversal main arm 11, and the other extremity to a stem 17.

The stem 17 carries, mounted idle on one of its ends, a roller 18, which engages a guiding track 19, situated beside the above line L in the area of the magazine S0.

The path of the guiding track 19 determines the far/close movement of the moving gripper 14 to and from the motionless gripper 12, thus defining the parted away 15A-close 15B condition of the pair of grippers.

Figure 4:
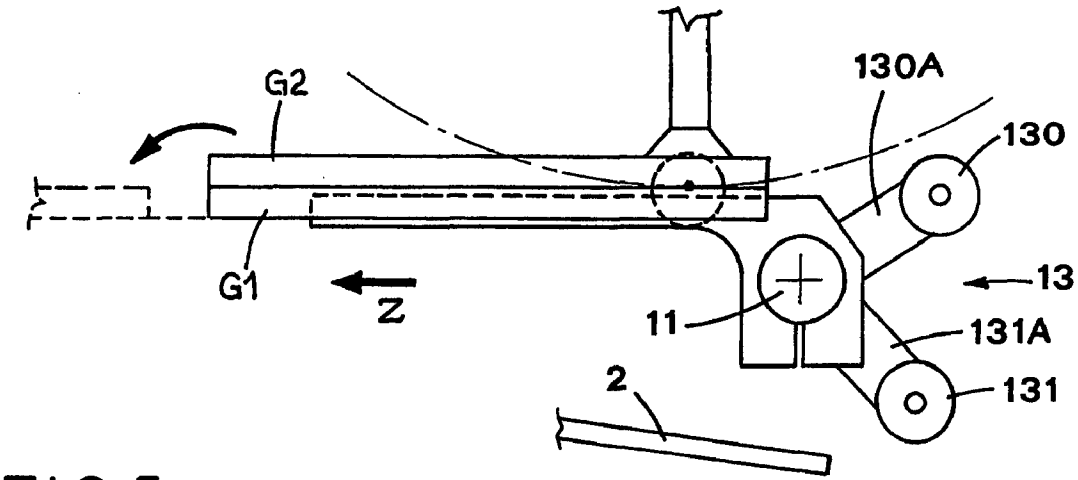
FIG. 4 is a lateral view, according to the arrow A of FIG. 2, of the picking up and transferring means in a particular working step.

The above mentioned rocker system 13 includes (as for example shown in detail in FIG. 4) a pair of rollers, upper 130 and lower 131, which are fastened with possibility to rotate, to one end of the relative arms, 130A and 131A, respectively.

The arms 130A and 131A are fastened to the main arm 11 on the side opposite to the pair of grippers.

The rocking system 13 inclines the pair of grippers 12, 14 downwards or upwards, according to different needs of the subsequent stations situated along the line L, thus making the rollers 130 or 131 engage the guiding tracks, shown in detail later on.

The proposed machine 100 includes a first working station S1, situated beside the line L, after the magazine S0, and equipped with a guiding track 2, which is situated lower than the line L at a variable distance therefrom, and which extends up to a subsequent second working station S2.

The guiding track 2 is hit, during the continuous movement of the gripping and transferring means 1, by the lower roller 131 (Figures from 5*a* to 5*c*) of the rocking system 13, so as to incline downwards the motionless gripper 12 and the moving gripper 14.

The first working station S1 includes also a partial opening device D2, which acts in the area of the outer surface of the upper closure member G2 of the container C, inclined downwards, so as to detach it from the lower closure member G1 and partially open the container C.

The device D2 includes, as shown in Figures from 5*a* to 5*c*, *a* drum 20, which rotates continuously on an axis parallel to the plane of the line L and perpendicular to the forward movement direction thereof.

The drum 20 carries, regularly spaced apart along the edge thereof, a plurality of protruding gripping elements 21, rotating with respect to the drum 20.

Figure 5A:
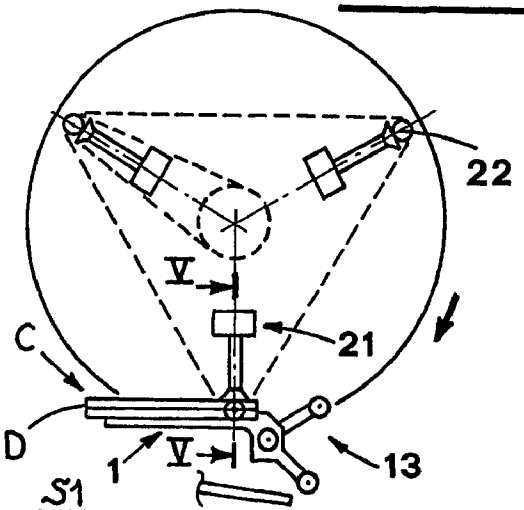
FIGS. 5*a*, 5*b* and 5*c* are schematic lateral views of means for partial opening of the containers in subsequent working configurations.
Figure 5B:
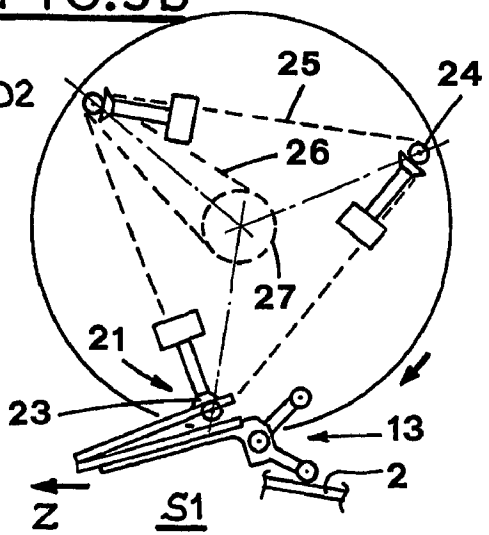
Figure 5C:
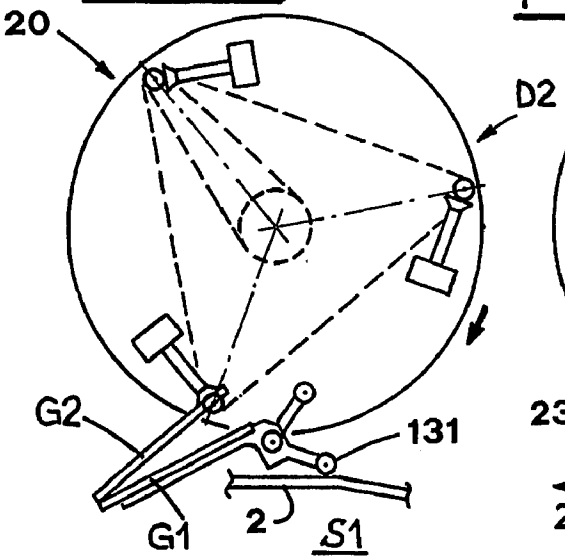
Figure 5D:
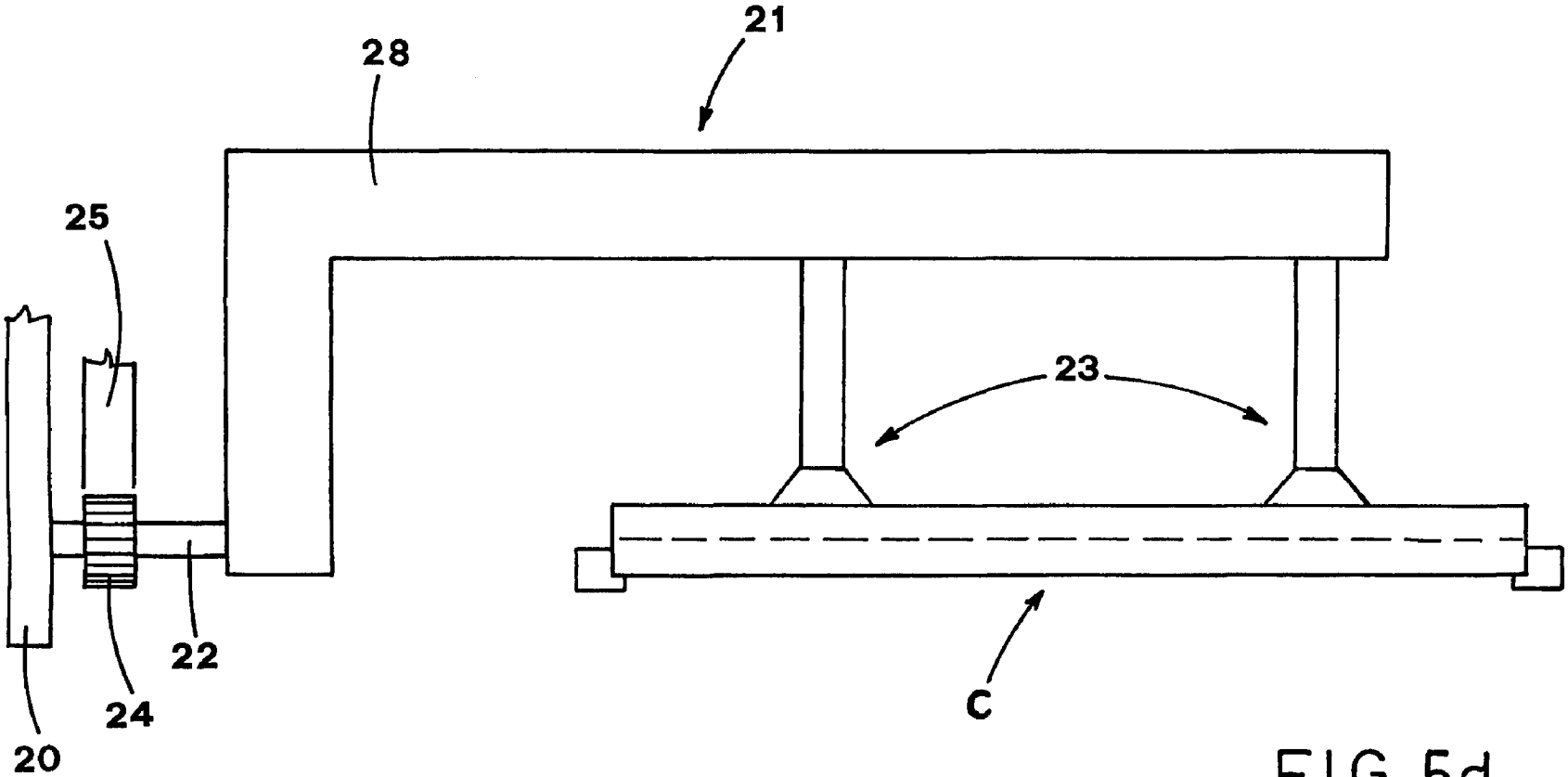
FIG. 5*d* is a section view along V—V of FIG. 5*a;*
Figure 6A:
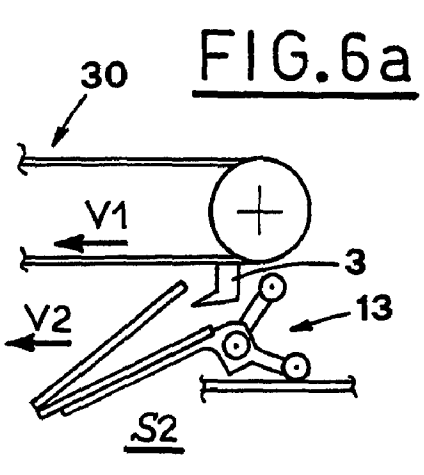
FIGS. 6*a*, 6*b* and 6*c* are schematic lateral views of means for completing opening of the containers in subsequent working configurations.
Figure 6B:
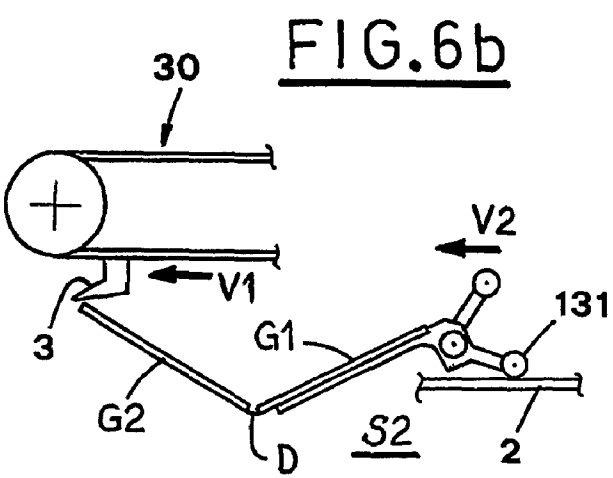
Figure 6C:
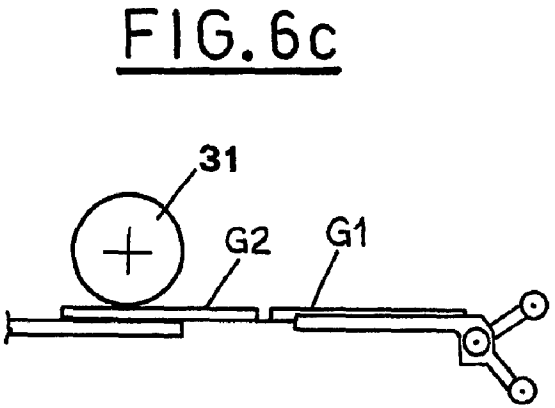

The gripping elements 21, as shown for example in FIG. 5*d*, are equipped with suction cups 23 connected rigidly, by means of an arm 28, to a shaft 22 carried by the drum 20.

A toothed belt 25 in mounted around toothed pinions 24, integral with the shafts 22, for driving the shafts into synchronous rotation, so that the gripping and transferring means 1 operate the gripping elements 21 to grip the upper closure members G2, in time relation with the continuous forward movement of the containers C.

An additional toothed belt 26 is mounted around at least one toothed pulley 27, motionless and coaxial to the drum 20, which drives the shafts 22 to counter-rotate with respect to the drum 20.

The machine 100 includes a second working station S2, situated along the line L, downstream of the first working station S1, which acts, in time relation with the continuous forward movement of the gripping and transferring means 1, on the upper closure member G2 of the containers C, which has been separated from the lower closure member G1 in the previous first working station S1, to rotate it around the hinge edge D up to 180° with respect to the lower closure member G1, so as to open completely the containers C and make them take a flat configuration.

The second working station S2 includes, as for example shown in Figures from 6*a* to 6*c*, striking means 3 for engaging the upper closure member G2, which are situated over the gripping and transferring means 1 and which are operated continuously along a close-loop conveyor 30, parallel to the line L, with a speed V1, higher than the speed V2 of the forward movement of the line L, so as to move the upper closure member G2 far from the lower closure member G1.

Thus, the striking means 3, cooperating with suitable stop means 31, define an aperture angle of 180° between the upper closure member G2 and the lower closure member G1, and maintain the container C in flat configuration during its transport to a subsequent, third working station S3.

The third working station S3 is situated along the line L, downstream of the second station S2, and a device D3 of the third working station S3 takes, in suitable time relation with the continuous forward movement of the gripping and transferring means 1, informative leaflets Li from a relative magazine and places them over the inner surface of the upper closure member G2, opened by 180° with respect to the lower closure member G1 in the previous working station S2.

The device D3 can include e.g. a plate 33, rotating on a horizontal axis parallel to the plane of the line L and equipped with a series of suction cups means 32, situated along its periphery.

The device D3 has been described and illustrated by the same Applicant in the Italian Patent Application No. BO200A 000084, according to which the plate rotated e.g. on a vertical axis.

The above mentioned suction cups means 32 are regularly spaced apart along the periphery of the plate 33 and rotate with respect to the plate 33.

Figure 7:
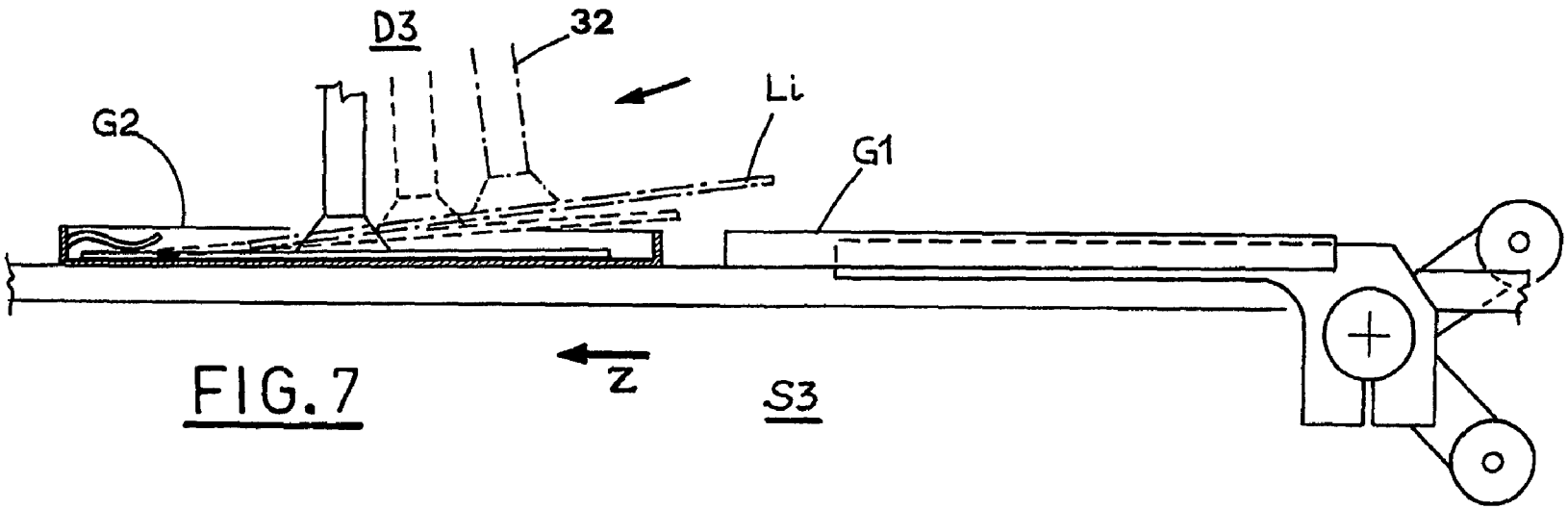
Figure 7A:
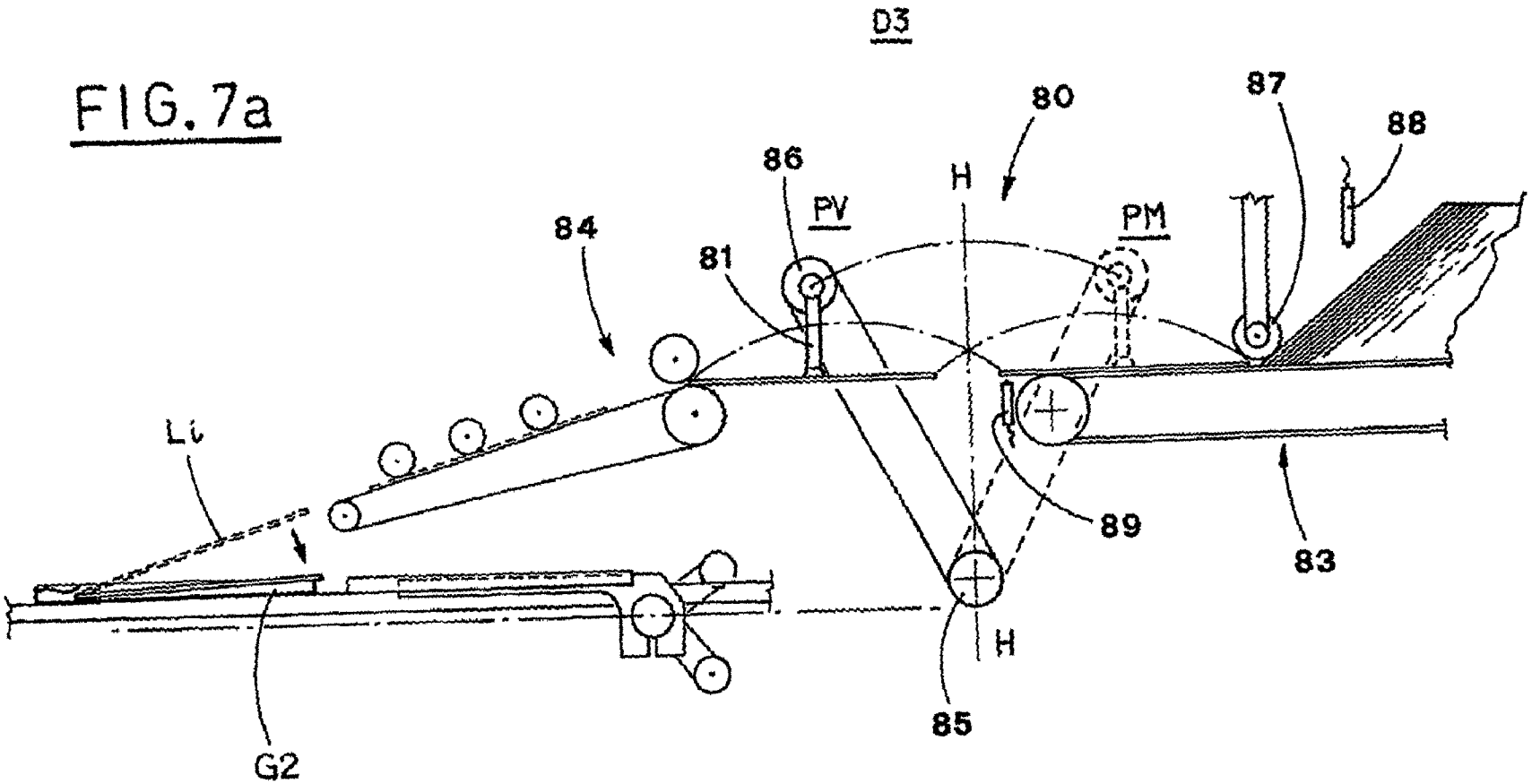

Otherwise, the device D3 can include, e.g. shown in FIGS. 7*a*, 7*b*, 7*c*, a withdrawing group 80, oscillating on a vertical axis H—H and equipped with gripping elements 81, e.g. suction cups.

When the oscillating withdrawing group 80 has reached a first extreme position PM, upstream of the axis H—H, the suction cups means 81 thereof take a corresponding informative leaflet Li out of a relative magazine, and after the oscillating withdrawing group 80 have reached a second extreme position PV, downstream of the axis H—H, the suction cups means 81 place the withdrawn informative leaflet in the region of the transferring means 84, which introduce it into the inner surface of the upper closure member G2.

The oscillating withdrawing group 80 includes a first motionless lower pulley 85, whose rotation center is situated on the axis H—H, and a second upper pulley 86, connected to an arm (not shown) oscillating on the axis H—H.

The two pulleys, lower 85 and upper 86, are connected by a belt.

The above mentioned suction cups 81 are rotatably fastened to the upper pulley 86, in the region of its rotation axis.

The magazine of informative leaflets includes a conveying belt, which accumulates a group of leaflets in the region of a withdrawing roller 87.

The roller 87 is operated, upon command issued by a suitable sensor element 88 in time relation with the passage of containers through the third station S3, to withdraw a single leaflet and to put it in the region of another sensor element 89, which activates the above mentioned oscillating withdrawing group 80.

The transferring group 84 includes conveying means, whose upper striking rollers are inclined toward the conveying line L, so as to place the leaflet Li exactly onto the inner surface of the upper closure member G2 passing below.

The device D3 includes also, situated immediately downstream of the transferring means 84, other working means 82 for completing the correct positioning of the informative leaflet Li inside the surface of the upper closure member G2.

The working means 82 include an accompanying arm 90 swinging on a relative first stationary end, and equipped, at the other end, with suitable means 91 capable of adhering with the upper surface of the informative leaflet Li, the accompanying arm 90 being operated by a lever 92, which is controlled in time relation with the forward movement of the conveying line L, by a rotating disc 93.

The working means 82 complete the introduction and correct positioning of the informative leaflet within the inner surface of the closure member G2.

The machine 100 includes a fourth working station S4, which is situated along the line L, downstream of the third station S3, and which takes, in time relation with the continuous forward movement of the gripping and transferring means 1, the articles 10 e.g. CDs, DVDs and the like, from an auxiliary conveying line La, situated beside the line L and moving synchronously with the latter.

The working station S4 transfers and introduces the withdrawn articles 10 into the inner surface of the lower closure member G1 of the corresponding containers C.

The fourth station S4 includes a device D4, shown in FIG. 1, which includes a rotary plate 4, situated between the line L and the above mentioned auxiliary conveying line La and rotating on an axis perpendicular to the plane defined by the line L.

The rotary plate 4 features a series of groups of withdrawing suction cups 41, which are situated along the plate edge.

The plate 4 is rotated in time relation with the continuous forward movement of the gripping and transferring means 1 and the continuous forward movement of the auxiliary conveying line La.

The above type of the device for withdrawing and transferring articles from an auxiliary line to a line for packaging the articles into relative containers, has been described and illustrated in the Italian Patent Application No. BO200A 000084 of the same Applicant.

In case of containers with protective film the proposed machine 100 includes a fifth working station S5, situated along the conveying line L, downstream of the fourth station S4.

The fifth working station S5, in time relation with the continuous forward movement of the gripping and transferring means 1, opens the lower closure member G1 and the upper closure member G2 by an angle wider than 180°, and separates, by suitable means (not shown), the protective film P, to allow a device D5 to insert a cover sheet F between the film P and the closure members G1, G2, in time relation with the continuous forward movement of the gripping and transferring means 1.

Means SM, associated to the fifth station S5, are situated beside the line L on a side opposite to the device D5 and are aimed at making a corrugation in the cover sheet F before it is introduced between the film P and the closure members.

Afterwards, the fifth station S5 brings the closure members G1, G2, previously opened by an angle wider than 180°, back to a flat configuration, so as to trap the cover sheet F between the closure members and the protective film P.

The fifth station S5 includes, as for example shown in FIG. 9, a guiding track 49, which is connected at top to the line L, and which is engaged by the upper roller 130 of the rocking system 13 of the gripping and transferring means 1, to incline the closure member G1 upwards.

Moreover, there are provided stabilizing means 50, which are situated above the line L and operate continuously and in time relation with the forward movement of the latter.

The guiding track 49, in cooperation with the stabilizing means 50, is also designed to open the closure members G1, G2 by an angle wider than 180°.

Figure 8A:
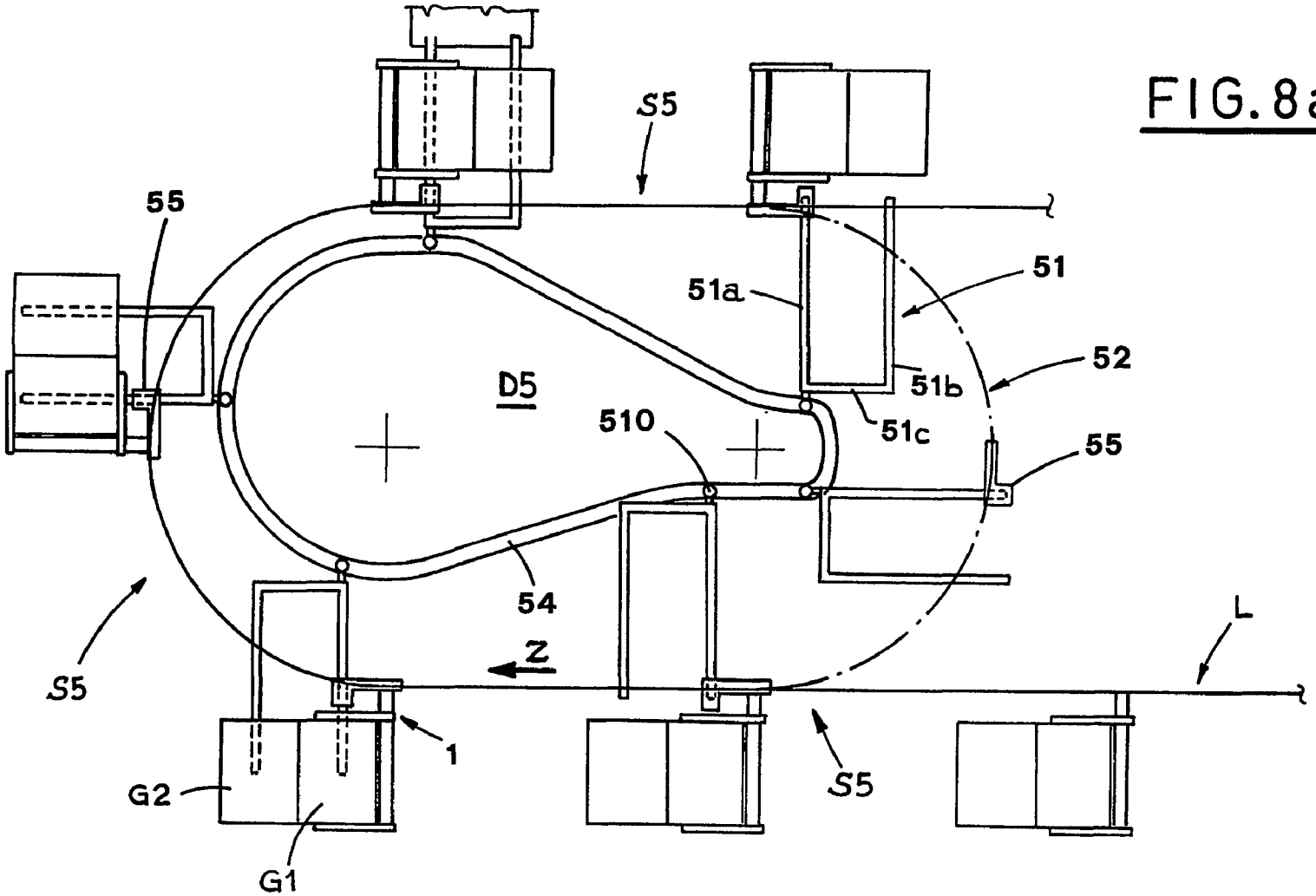

The above mentioned device DS for inserting the cover sheet F into the area W, defined by detaching the film P from the closure members G, G2, can be like the one described and illustrated in the Patent Application filed today by the same Applicant, The device D5 includes, as shown in FIGS. 8*a*, 8*b*, gripping means 51, operated with a continuous motion and in time relation with the forward movement of the gripping and transferring means 1, by conveying means 52, situated beside the line L, on the side opposite to the means SM, so that they have no motion relative to the movement of the opened container C along the line L in the station S5, with respect to the gripping and transferring means 1.

The gripping means 51 include at least one pair of prongs 51*a*, 51*b* which introduce in the area W delimited by the opened closure members G1, G2 and by the protective film P.

The prongs 51*a*, 51*b* are equipped with corresponding means 53 for clamping removably the cover sheet F, corrugated by the means SM, and for dragging it into the area W.

During the introduction into the area W and leaving thereof, the prongs 51*a*, 51*b* are operated by guiding sleeves 55 fastened to the conveying means 52.

Each of the pairs of prongs 51*a*, 51*b* is oriented with respect to the area W by a cam profile 54 (extending in an endless path), inside which a roller 510 slides, the roller being integral with the arm 51*c* connecting the inner ends of the prongs 51*a*, 51*b*.

Figure 10:
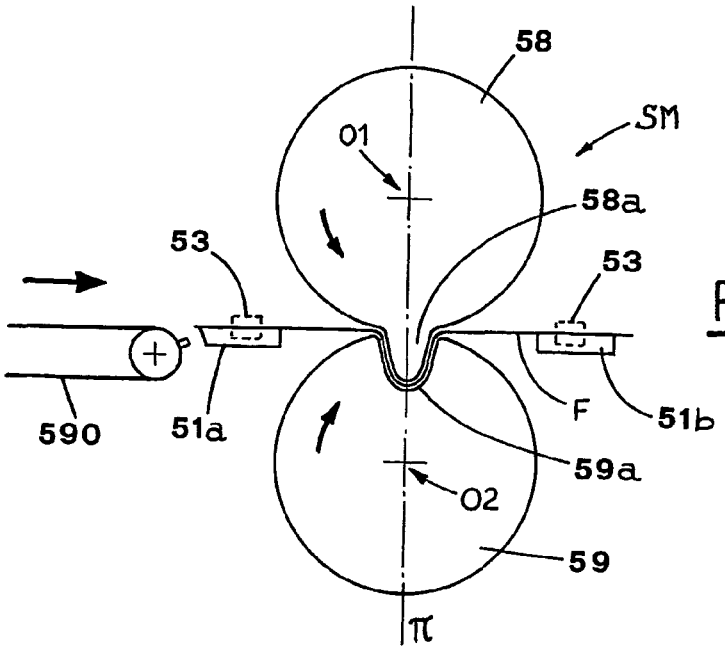
FIG. 10 is a section view taken along X—X of FIG. 8*b;*

As shown in FIG. 10, the means SM include a pair of cylinders 58, 59, swinging in opposite directions on respective rotation axes O1, O2, which are aligned along a vertical plane π, and having exactly alike profiles, respectively male 58*a* and female 59*a*, which mate each other to corrugate the sheet F, previously picked up from a conveyor 590.

Finally, the machine 100 includes a sixth station S6 and a seventh station S7, situated along the line L, downstream of the fifth working station S5 in case the cover sheet F is to be introduced (as in the illustrated example), or downstream of the fourth station S4.

The sixth station S6 closes the containers C in time relation with the continuous forward movement of the gripping and transferring means 1, and the seventh station S7 transfers the finished containers toward a collecting unit U and the faulty containers toward a discharge unit U1.

Figure 11A:
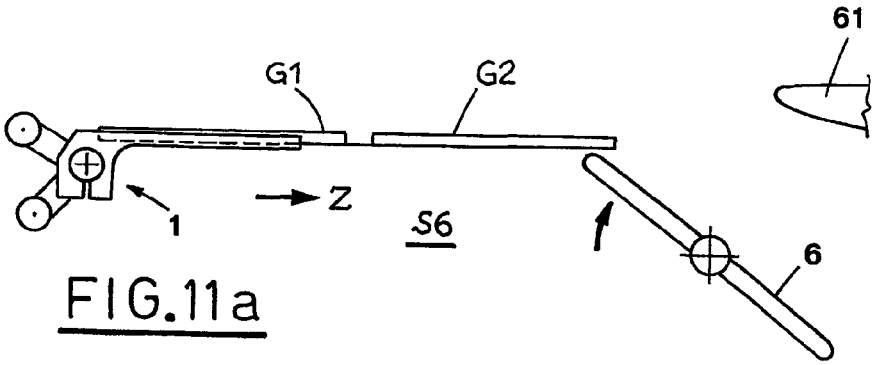
FIGS. 11*a* and 11*b* are lateral schematic views of means for closing containers in subsequent working configurations.
Figure 11B:
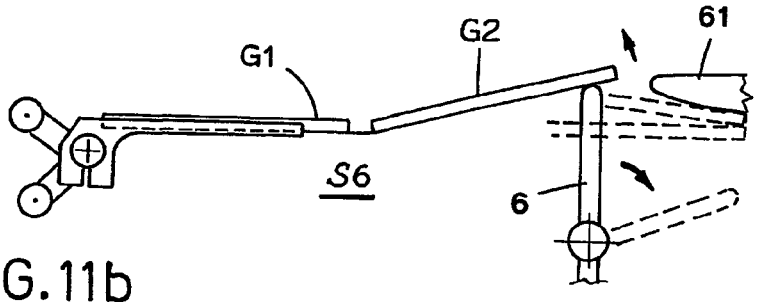

As shown in FIGS. 11*a*, 11*b*, the sixth station S6 includes a member 6 which partially raises the upper closure member G2 and is situated beside the line L.

The raising member 6 rotates the upper closure member G2 along the hinge edge D joining it with the lower closure member G1, so as to move both closure members close to each other.

The sixth station S6 includes also a stationary striker 61, situated above the line L and acting, against the forward movement of the container C, on the outer surface of the upper closure member G2, to bring it back to the lower closure member G1 and close the container.

Figure 12:
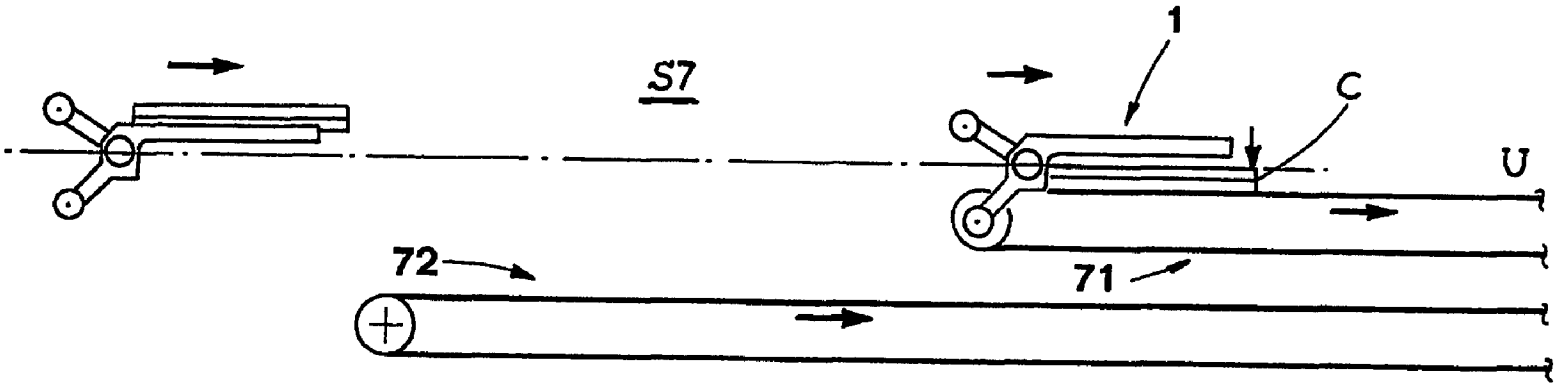
FIGS. 12 and 13 show schematically separate transferring steps of closed packaged containers and of defective containers, respectively.
Figure 13:
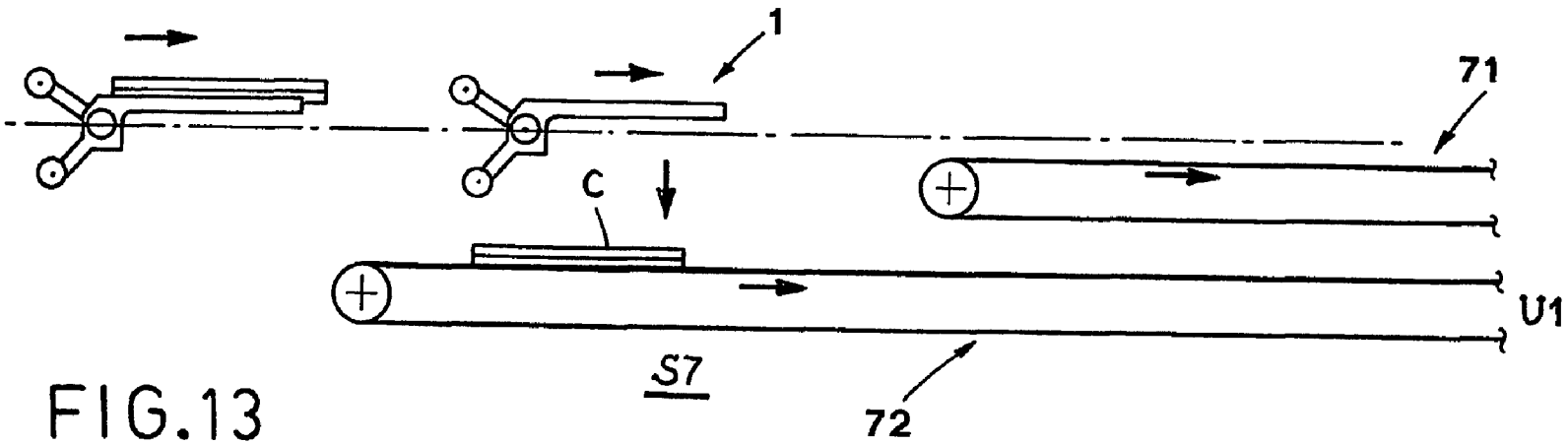

The seventh station S7 includes a guiding track, which is engaged by the transmission system 15 of the gripping and transferring means 1, to make the latter take the parted away condition 15A, to release the packaged containers on a first upper conveying belt 71 (FIG. 12) and transfer them to the collecting unit U, as well as to release the faulty finished containers on a second lower conveying belt 72 (FIG. 13) to transfer them to the discharge unit U1.

Now, the operation of the proposed machine will be briefly described, taking as the example a working cycle of packaging a container C* and as the starting point the positioning of the gripping and transferring means 1 upstream of the magazine S0.

The gripping and transferring means 1 are operated in continuous fashion along the line L toward the magazine S0 and the roller 18 of the transmission system 15 gets in engagement with the guiding track 19 thus moving the moving gripper 14 far from the motionless gripper 12.

The so opened grippers can grip the lowermost container C* of the pile of containers stored in the magazine S0.

The roller 18 leaves the guiding track 19 in time relation with the passage of the opened grippers near the container C*, thus allowing the moving gripper 14 to move close to the motionless gripper 12 (FIG. 2, close condition 15B): in this way, the grippers 12, 14 grip the lower closure member G1 of the container C*.

Then, the gripping and transferring means 1 convey the container C*, in closed condition, toward the first working station S1.

The lower roller 131 of the balancing system 13 engages the guiding track 2, inclining the container C* downward, while the gripping means 21 of the device D2 grip the outer surface of the upper closure member G2, moving it slightly far from the lower closure member (Figures from 5*a* to 5*c*).

The container C*, inclined and partially opened, is conveyed toward the second station S2, where the intercepting means 3 act on the upper closure member G2, moving the latter still farther from the lower closure member G1, until the container reaches a flat configuration, while the lower roller 131 leaves the guiding track 2, bringing the container C* back to the horizontal position.

The stop means 31 keep the two closure members opened by an angle of substantially 180 degrees (Figures from 6*a* to 6*c*) and parallel to the line L.

The so opened container C* is conveyed to the third working station S3, where the device D3 introduces at least one informative leaflet into the inner surface of the closure member G2 (FIG. 7 and FIGS. 7*a*, 7*b*, 7*c*).

Then, the container C*, still in open and flat configuration, is conveyed to the fourth working station S4, where the device D4 introduces into the inner surface of the closure member G1 at least one article 10, previously picked up from the auxiliary line La.

At this point, the container C*, containing between the relative closure members G1, G2 at least one article 10 (e.g. a DVD) and at least one informative leaflet Li, is conveyed to the fifth working station S5.

The upper roller 130 of the rocking system 13 engages the guiding track 49 thus inclining the closure member G1 upwards, while, at the same time, the stabilizing means 50 act on the end of the closure member G2 opposite to the joining edge D, thus opening the two closure members G1, G2 by an angle wider than 180°.

Suitable means detach, in time relation with the above opening of the closure members, the protective film P from the opened closure members, thus allowing the gripping means 51 of the device D5, which are guided by the sleeves 55 along a cam 54, to enter the area W, defined between the film P and the closure members G1, G2 and to grip the cover sheet F, corrugated by the means SM.

The gripping means 51, still guided by the guiding sleeves 55 along the cam 54, bring the cover sheet F into the area W, between the film P and the closure members G1, G2.

In time relation with the insertion of the corrugated cover sheet F between the film P and the closure members G, G2, the gripping means 51 release the sheet F, the protective film P is released by the relative gripping means, the upper roller 130 leaves the guiding track 49 and the stabilizing means 50 release the closure member G2.

What above allows the closure members to take a flattened configuration, trapping the protective film P and the cover sheet F therebetween.

Afterwards, the container C* is conveyed to the sixth working station S6 (FIGS. 11*a* and 11*b*), where the raising member 6 and the motionless stationary striker 61 close the container C* by bringing the closure member G2 back onto the closure member G1.

The so prepared container C* is brought to the seventh working station S7, where the roller 18 gets in engagement with a guiding track and thus open the grippers, making the container C* fall onto the first conveyor 71, in case the container is faultless, or onto the second conveyor 72, in case the container is faulty.

Therefore, the proposed machine obtains the object of packaging automatically and continuously articles, in particular DVDs, into related containers.

Moreover, the previously described and illustrated machine allows advantageously to maintain a constant, continuous and high operation speed, with which the containers are brought to the subsequent working stations, thus increasing considerably the production rate with respect to known machines.

It is also to be pointed out that the proposed machine can optimize and coordinate the whole of the working steps necessary to package articles into relative containers, thus allowing advantageously the working stations to work continuously and at their full capacity.

It is to be pointed out that the proposed machine allows to gain the above advantages by a simple, extremely functional and reliable technical solution.

It is understood that what above, has been described as a pure, not limitative example, therefore, possible variants of the invention remain within the protective scope of the present technical solution, as described above and claimed hereinafter.

What is claimed is:

1. A machine for packaging articles in related containers formed by a lower substantially box-like closure member (G1) and an upper substantially box-like closure member (G2) hinged to each other along a common hinge edge (D), the lower and upper closure members having edges opposite to said hinge edge having locking means, said closure members receiving respectively therein at least one article (10) and at least one informative booklet (Li), said machine comprising a conveying line (L), having located about the periphery thereof, gripping and transferring means (1) for gripping lateral edges of said lower closure member (G1) of said containers (C) located, in a closed condition, inside a magazine (S0), said gripping and transferring means (1) removing said closed containers (C) from a bottom of said magazine (S0) and transferring said containers to one or more working stations along said conveying line (L), said working stations operated in a time relation with a forward movement of said gripping and transferring means (1), for opening the containers by displacing the upper closure member (G2) with respect to the lower closure member (G1), for introducing into said closure members, respectively, the at least one informative leaflet (Li) and the at least one article (10), and for closing the container.

2. The machine, according to claim 1 wherein said gripping and transferring means (1) include a main arm (11), which is transversely supported by a guiding track (B) made in the conveying line (L) and which is driven by a rocking system (13) so as to rotate on an axis (O) Lying on a plane defined by the conveying line (L) and perpendicular to the forward movement direction (Z) of the conveying line, said main arm (11) having a pair of grippers, a first gripper (12) and a second gripper (14), movable with respect to each other, said first and second grippers being parallel to each other and cantilevered to the main arm (11), protruding in the forward movement direction of said line (L), said grippers being opened by a transmission system (15) so as to pass from an opened condition (15A) to a closed condition (15B), said grippers, when in said opened condition (15A) being moved by said line (L) in correspondence to said magazine (S0), until the grippers engage with the lower closure member (G1) of a lowermost container (C*) in said magazine (S0), and, when moved to said closed condition (15B) by said transmission system (15), said grippers gripping the lateral edges of said lower closure member (G1) of said lowermost container (C*) to remove the lowermost container from said magazine (S0) and to transfer the lowermost container to subsequent working stations.

3. The machine according to claim 2 wherein said first gripper (12) and said second gripper (14) are respectively motionless and axially movable with respect to the main arm (11).

4. The machine according to claim 2 wherein said transmission system (15) has a traction spring (16) with a first extremity fastened to a lower area of the main arm (11), and a second extremity fastened to a stem (17), said stem carrying a roller (18) which engages a guiding track (19), situated beside said line (L) in an area of said magazine (S0), displacement of the guiding track (19) defining said opened and closed conditions of said pair of grippers.

5. The machine according to claim 2 wherein said rocking system (13) includes an upper roller and a lower roller, each fastened to one end of a pair of arms, (1 30A and 131A), said arms (130A, 131A) to said main arm (11) at a side opposite to the pair of grippers.

6. The machine according to claim 2 wherein said one or more working stations includes a first working station (S1) which detaches the upper closure member from the lower closure member (G2) and partially opens said container (C).

7. The machine according to claim 6 wherein said first working station (S1) includes a guiding track (2), which is situated lower than the line (L) at an adjustable distance from said line, and which extends up to a subsequent second working station, said guiding track (2) being engaged during the continuous movement of the gripping and transferring means (1) by said rocking system (13), so as to incline downwards said first griper (12) and said second gripper (14), such that a partial opening device (D2) which acts in an area of an outer surface of the upper closure member (G2), detaches the upper closure member from the lower closure member (G1) and partially open the container (C).

8. The machine according to claim 7 wherein said opening device (D2) includes a drum (20), which rotates, in time relation with the forward movement of said gripping and transferring means (1), on an axis parallel to a plane defined by said line (L) and perpendicular to the forward movement direction thereof, said drum (20) carrying a plurality of protruding gripping elements (21), rotating with respect to said drum (20).

9. The machine according to claim 8 wherein said gripping elements (21) each include respectively a shaft (22), rotatably carried by said drum (20) in coaxial relation therewith, said gripping elements (21) having suction cups (23), said shafts (22) carrying respective toothed pinions (24) around which a tooted belt (25) is mounted for driving said shafts (22) to rotate synchronously, to operate said gripping elements (21) in time relation with the forward movement of the containers (C).

10. The machine according to claim 9 further comprising an additional toothed belt (26) mounted around at least one of said pinions (24) and being engaged with a toothed pulley (27), motionless and coaxial wit said drum (20), so as to drive said shafts (22) to counter-rotate with respect to the drum (20).

11. The machine according to claim 6 wherein said one or more working stations includes a second working station (S2), which acts, in time relation with the forward movement of the gripping and transferring means (1), on the upper closure member (G2) of said containers (C), separated from the lower closure member (G1) in the first working station (S1), to rotate said upper closure member around the hinge edge (D) by 180° with respect to the lower closure member (G1), so as to open completely the container (C), the container assuming a flat configuration.

12. The machine according to claim 11 wherein said second station (S2) includes striking means (3) for striking the upper closure member (G2), the striking means situated over the gripping and transferring means (1) and being operated along an endless conveyor (30) located parallel to the line (L), and having a speed (V1) higher than a speed (V2) of the forward movement of the line (L), so as to move the upper closure member (G2) far from the lower closure member (G1) and to define, in cooperation with stop means (31), an aperture angle of 180 degrees between the upper closure member (G2) and the lower closure member (G1), and to maintain to container (C) in a flat configuration during transport to a subsequent working station.

13. The machine according to claim 2 wherein said one or more working stations includes a third working station (S3), having a device (D3) for withdrawing said informative leaflets (Li) from a related magazine and inserting said informative leaflets into an interior of the upper closure member (G2), when in an opened condition.

14. The machine according to claim 13 wherein said device (D3) includes a plate (33), rotating, in time relation with the forward movement direction of said gripping and transferring means (1), on an axis parallel to a plane defined by the line (L) and perpendicular to the forward movement of said line (L), said rotating plate (33) having a series of suction cups means (32), spaced regularly along a periphery of the rotating plate (33).

15. The machine according to claim 13 wherein said device (D3) includes a withdrawing group (80), which is situated near and above said line (L), said withdrawing group (80) oscillated on a vertical axis (H—H) and having suction gripping elements (81), said withdrawing group (80) withdrawing an informative leaflet (Li) from a storage magazine (83), and delivering the withdrawn informative leaflet to transferring means (84), which introduce the informative leaflet into the interior of the upper closure member (G2), said device (D3) having working means (82) situated downstream of said transferring means (84) for completing an introduction of the informative leaflet (Li) into the interior of said upper closure member (G2).

16. The machine according to claim 15 wherein said storage magazine (83) includes a conveying belt for accumulating a group of leaflets (Li) in a region of a withdrawing roller (87), said withdrawing roller (87) operated in responsive to a sensor element (88), in time relation with the passage of containers in said third station (S3), to withdraw a single leaflet (Li) and to put the single leaflet in a region of a second sensor element (89) situated at an end of said conveying belt.

17. The machine according to claim 15 wherein said oscillated withdrawing group (80) has a first motionless lower pulley (85), having a rotating center situated in correspondence to the vertical axis (H—H), and a second upper pulley (86), connected to an arm oscillating on said axis (H—H), and rotatably carrying fastened thereto said withdrawing suction cups means (81), said lower pulley (85) and said lower pulley upper (86) being linked by a belt.

18. The machine according to claim 15 wherein said working means (82) include an accompanying an (90) swinging on a relative first fixed end, and equipped, at another end, with means (91) for adhering with an upper space of said informative leaflet (Li), said accompanying arm (90) being operated by a lever (92), which is controlled in time relation with the forward movement of the conveying line (L), by a rotating disc (93).

19. The machine according to claim 2 wherein said one or more working stations includes a fourth working station (S4) for withdrawing, in time relation with the continuous forward movement of the gripping and transferring means (1), articles (10) from an auxiliary conveying line (La), which, is situated beside the line (L) and which moves synchronously therewith, said fourth working station (S4) transferring and introducing the withdrawn articles (10) into the interior of the lower closure member (G1).

20. The machine according to claim 2 wherein said one or more working stations includes a fifth working station (S5)

for opening, in time relation with the continuous forward movement of the gripping and transferring means (1), the lower closure member (G1) and the upper closure member (G2) by an angle wider than 180°, and for separating a protective transparent film (P) wrapping said closure members fastened thereto in correspondence to edges opposite to the hinge edge (D), a device (D5), connected to said line (L) in correspondence to said fifth station (S5), inserting a cover sheet (F) between the film (P) and said closure members, in time relation with the continuous forward movement of the gripping and transferring means (1).

21. The machine according to claim 20 wherein said fifth station (S5) includes means (SM), situated beside said line (L) on a side opposite to the device (D5), for making a corrugation in the cover sheet (F) before said cover sheet is inserted between the film (P) and the closure members, said fifth station (S5) thereafter bringing the closure members (G1,G2) back to a flat configuration, so as to trap the cover sheet (F) between the closure members and the protective film (P).

22. The machine according to claim 2 wherein said one or more working stations includes a sixth working station (S6) for closing the containers (C) in time relation with the continuous forward movement of the gripping and transferring means (1).

23. The machine according to claim 22 wherein said sixth working station (S6) includes a raising member (6), situated beside the line (L), for partially raising the upper closure member (G2), said raising member (6) rotating, in time relation with the forward movement of the gripping and transferring means (1), the upper closure member (G2) along the hinge edge (D), to move both closure members close to each other, said sixth station (S6) having a stationary striker (61), situated above the line (L) and acting on the outer surface of the upper closure member (G2) moving in the forward movement direction, to move the upper closure member towards the lower closure member (G1) to close the container.

24. The machine according to claim 2 wherein said one or more working stations includes a seventh station (S7), which, in time relation with the forward movement of said gripping and transferring means (1), receives either a finished container (C), or a faulty container, the finished container released by said gripping and transferring means (1), being transferred to a collecting unit (U), the faultily container (C), released by said gripping and transferring means (1), being transferred to a discharge unit (U1).

25. The machine according to claim 24 wherein said seventh station (S7) includes a first conveying belt (71), connected to said line (L) at a first lower level, to receive finished containers (C), and a second conveying belt (72), connected to said line (L) at a second lower level, to receive faulty containers.

26. The machine according to claim 1 wherein said gripping and transferring means (1) are moved continuously by said conveying line (L).

27. The machine according to claim 1 wherein said conveying line (L) follows an endless path (A), disposed on a horizontal plane, said one or more working stations being situated on one side of said line along said endless path (A).

* * * * *